United States Patent [19]

Johnson et al.

[11] Patent Number: 4,795,413

[45] Date of Patent: Jan. 3, 1989

[54] METHOD AND APPARATUS FOR AUTOMATICALLY OPENING BAGS

[75] Inventors: Robert B. Johnson, Santa Clara; Robert P. Smith, Santa Cruz, both of Calif.

[73] Assignee: K & R Equipment Incorporated, San Jose, Calif.

[21] Appl. No.: 44,005

[22] Filed: Apr. 29, 1987

[51] Int. Cl.[4] ..... B31B 1/78; B31B 7/80

[52] U.S. Cl. ..... 493/309; 493/101; 29/239; 53/384; 156/344; 156/584

[58] Field of Search ..... 29/239; 53/384; 156/344, 584; 493/101, 309

[56] References Cited

FOREIGN PATENT DOCUMENTS 100829 3/1962 Netherlands ..... 53/384

*Primary Examiner*—Robert P. Olszewski
*Assistant Examiner*—William E. Terrell
*Attorney, Agent, or Firm*—Limbach, Limbach & Sutton

[57] ABSTRACT

The invention provides an apparatus and method for automatically opening a plastic bag-type liner as part of a container lining process. The apparatus comprises at least one movable jaw assembly disposed on each side of the liner to be opened and a tongue on the other side of the liner opposing each jaw assembly. To open the bag, the jaws are opened and the jaw assemblies are moved toward and contact the liner and the opposing tongue pushes the liner between the gripping surfaces of the jaws of the opposing jaw assembly; as the jaw assemblies begin to move apart, the jaws close, gripping and retaining the layer of liner in direct contact with the gripping surfaces of each jaw, the tongues slide out from between the layers of the liner, separating the sides of the unsealed end of the liner. A stream of air may then be directed into the open end of the bag for completely blowing the bag open prior to placing the bag over the open end of the container to be lined and forcing the liner into the container.

18 Claims, 2 Drawing Sheets

METHOD AND APPARATUS FOR AUTOMATICALLY OPENING BAGS

TECHNICAL FIELD

The present invention relates to methods and equipment for lining containers. In particular, the present invention provides a method and apparatus for automatically opening a bag-type liner prior to inserting the liner into the container to be lined.

BACKGROUND ART

A thin, flexible plastic liner or the like is often employed in a shipping box or other container to increase the shelf life of foods or other perishable commodities or to prevent leakage or spillage of product from a sealed shipping container. Such plastic liners are often in bag form. Heretofore, such plastic liners were often manually placed in the container or manually placed on a mandrel which was then used to line the container. The liner can also be manually placed over the open end of the container to be lined and then the liner can be automatically forced into the container by drawing the lining into the container using vacuum, as shown in U.S. Pat. No. 4,052,931 to Morse et. al., or by blowing the liner into the container, as shown in U.S. Pat. No. 4,537,584 to Everman et. al. Some attempts have been made to automatically open the liner before placing the liner over the open end of a container by using vacuum assemblies as shown in U.S. Pat. Nos. 4,522,012 to Nelson, 4,083,293 to Goldstein, and 4,537,584 to Everman et. al. However, the use of such vacuum assemblies in a totally automated lining process has been problematical. Vacuum cup or vacuum bar assemblies do not provide a positive grasp on each side of the liner to enable the sides of the liner to be completely pulled apart. In addition, simply separating the sides of the bag at the open end thereof does not completely open the bag since the sides of the bag tend to cling together due to surface tension or other adhesion between the inner surfaces of the liner. If the liner is not completely opened before it is placed over the upstanding flaps of the container, the liner will tear. Attempts to break such surface tension or adhesion while using vacuum cups or bars to separate the sides of the liner have not been successful. Thus, the need exists for a means of achieving the effective and positive automated opening of an unsealed end of a thin, flexible plastic film liner and for a method of breaking any surface tension or adhesion between the inner surfaces of the liner prior to inserting such a liner into a container. The present invention solves these problems by providing a novel jaw assembly and automated bag opener which frictionally grasps and separates the sides of a bag-type liner at the open end and securely holds the liner while it is completely opened, for example, by blowing air into the open end.

SUMMARY OF THE INVENTION

The present invention provides an apparatus and method for automatically opening a bag-type liner for a container prior to inserting the liner into the container.

In one embodiment, the present invention provides a jaw assembly and method for grasping and frictionally holding one ply or layer of thin, flexible material such as are used to manufacture plastic liners for containers. The jaw assembly consists of two jaws, each having a gripping surface and connected so that when the jaw assembly is in a closed position, the gripping surfaces are in contact and when the jaw assembly is in an open position, the gripping surfaces are spaced away from each other. The jaw assembly also includes a means for moving at least one of the jaws to provide the open and closed position. Thus, when one or more layers of plastic are placed between the gripping surfaces of the jaws, and the jaw assembly closes, the layer in direct contact with the gripping surfaces is firmly held.

In another embodiment, the present invention provides an automatic bag opener and method for grasping, frictionally holding, and separating the two sides of a bag-type liner. In this embodiment, at least one jaw assembly is provided for each side of the plastic liner, and a tongue is provided on the other side of the liner opposite each jaw assembly for pushing the layers of the bag between the gripping surfaces of the jaws. Thus, when the bag opener is in the grasping position, the jaw assemblies and opposing tongues are moved toward and contact the unsealed end of the liner, and each tongue pushes the layers of material in the liner into the open jaws between the gripping surfaces of each opposing jaw assembly. When the bag opener moves to the separating position, the jaw assemblies and opposing tongues are pulled apart, the tongues slide out from between the layers of plastic as the jaws close, the layer of material in direct contact with the gripping surfaces of each jaw assembly being positively held and any other layers are pulled away by the opposing jaw assembly. Finally, when both sides of the open end of the liner are spread apart, the bag is fully opened, for example, by blowing open using compressed air.

In yet another embodiment, the present invention provides an improved apparatus and method for lining containers in which the liner is opened using an automatic bag opener which frictionally grasps and separates each side of a bag-type liner at the unsealed end and fully opens the bag prior to insertion in the container.

BRIEF DESCRIPTION OF THE DRAWINGS

A better understanding of the invention and its advantages will be apparent from the detailed description taken in conjunction with the accompanying drawings in which.

DETAILED DESCRIPTION OF THE INVENTION

Figure 1:
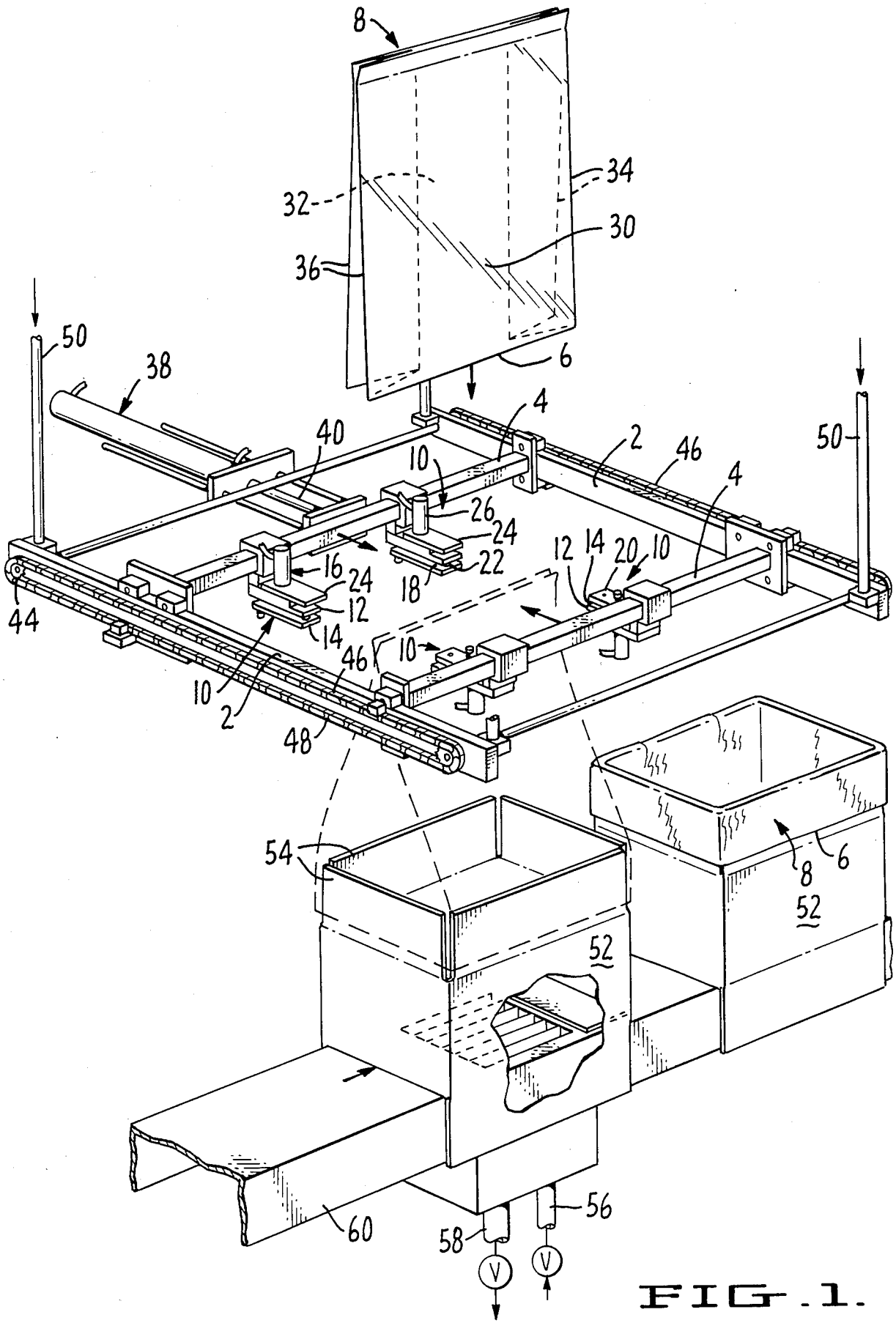
FIG. 1 is a perspective view of the apparatus and method of the present invention for the automated lining of containers which includes the automated opening of the liner prior to the insertion of the liner into the container.

FIG. 1 shows the method and apparatus for lining a container with a plastic bag-type liner. The automatic bag opener comprises a frame 2 on which is mounted preferably two arms 4, at least one of said arms 4, and preferably both, being slidably movable on frame 2. Said arms 4 are disposed such that the open or unsealed end 6 of liner 8 can be lowered between said arms 4. It is also possible that more than one arm 4 could be mounted on each side of liner 8. Each arm 4 has mounted thereon at least one, and preferably two, jaw assemblies 10. Each jaw assembly consists of a first jaw 12, a second jaw 14, and a means 16 for connecting both jaws and moving at least one of the jaws. Each jaw contains an inner surface 18, an outer surface 20, and a gripping surface 22, which preferably consists of a rubber pad or layer. One skilled in the art will recognize, however, that other materials having a high coefficient of friction relative to the surface of liner 8, or simply roughening the inner surface 18 itself will also provide a suitable gripping surface if the coefficient of friction between the gripping surface 22 and the side of liner 8 exceeds the coefficient of friction between the two sides of liner 8. The jaws are moved in relation to each other by means 16, which preferably is a hydraulic or compressed air ("air") cylinder 26 having a movable piston 28. In the preferred embodiment, the first jaw 12 is attached to the cylinder 26 while the second jaw 14 is attached to the movable piston 28. Movement of the second jaw 14 relative to the first jaw 12 is thus controlled by controlling the flow of fluid or air to the cylinder 26, as is well known in the art.

Mounted on arms 4 on the other side of liner 8 and disposed opposite each jaw assembly 10, is a tongue 24. By placing a tongue 24 and jaw assembly 10 on each side of liner 8, a cooperative relationship results such that when the two arms 4 are moved toward each other each tongue 24 and opposing jaw assembly 10 contact the unsealed end 6 of liner 8 and tongue 24 pushes the layers of thin, flexible material of liner 8 between gripping surfaces 22 of the opposing jaw assembly 10. When the jaws close and the arms 4 are moved apart, the opposing tongue 24 is removed and the gripping surfaces 22 of the jaw assembly 10 securely hold the layer of plastic in direct contact with the gripping surfaces 22. The other layer of plastic, which is in direct contact with the gripping surfaces of the other jaw assembly 10, is pulled away from the first jaw assembly 10 as the arms 4 are moved apart. In the preferred embodiment, the tongue 24 is mounted to the outside surface of the first jaw 12 and jaw assemblies 10 are mounted on the arms 4 to oppose and cooperate with each other. Also in the preferred embodiment, two such preferred jaw assemblies 10 are mounted on each side of liner 8 so that the jaw assemblies 10 mounted on first side 30 of liner 8 will grasp the unsealed end 6 of liner 8 with one jaw assembly 10 grasping at about the first edge 34 and with the other jaw assembly 10 grasping at about the second edge 36 thereof, and so that the two jaw assemblies 10 mounted on the second side 32 of liner 8 will grasp the unsealed end 6 of liner 8 at about the first edge 34 and at about the second edge 36. As discussed above, said arms 4 are mounted on frame 2 so that at least one arm 4, and preferably both arms 4 are slidably movable. The arms 4 are preferably moved by using at least one, and preferably two, chain drives 42 consisting of an endless chain loop 44 having an upper surface 46 and a lower surface 48, and means for moving the chain. One arm 4 engages the upper surface 46 of chain drive 42 and the other arm 4 engages the lower surface 48 of chain drive 42. Thus, when the chain of chain loop 44 moves in one direction, both arms 4 are moved toward each other, and when the chain of chain loop 44 is moved in the opposite direction, the arms 4 are moved away from each other. In the preferred embodiment the means for moving the chain loop 44 is a hydraulic or air cylinder 38 having a piston 40 attached to one of the arms 4 engaging the chain drive 42. Thus, when the end of piston 40 is pushed away from cylinder 38, arm 4 is pushed toward liner 8, moving the chain of chain loop 44, which in turn moves the other arm 4 toward liner 8. When piston 40 is retracted into said cylinder, the piston 40 pulls arm 4 away from liner 8, arm 4 moves the chain of chain loop 44 which, in turn, moves the other arm 4 away from liner 8. The chain loop 44 could also be moved using a variety of other drive means including a hand crank or motor.

The frame 2, arms 4, jaw assemblies 10, chain drive 42 and cylinder 38 comprise an apparatus for grasping and separating the sides of liner 8. This apparatus can be adapted to be used in a bag lining apparatus by movably mounting the frame 2 and associated components to a support structure 50 which will hold the bag grasping and separating apparatus and permit the apparatus to move between liner 8 and container 52. The means for moving the apparatus between liner 8 and container 52 preferably is a hydraulic or air cylinder, but may include other means as are well known in the art, such as a chain drive. This arrangement permits frame 2 to be moved so as to align jaw assemblies 10 with the unsealed end 6 of liner 8 to perform the grasping and separating functions discussed above. Following grasping and separating, the frame 2 is moved toward the open end of container 52. The jaw assemblies 10 pull end 6 of liner 8 over upstanding flaps 54 after the bag has been completely opened by a stream of air from air tube 56 directed between the separated sides of liner 8 which blows liner 8 open. This is preferably done using a compressed air source. Following bag opening and placement over upstanding flaps 54, the liner 8 is forced into container 52, preferably by using a vacuum applied to the interior of container 52. In the preferred embodiment, container 52's bottom is not sealed prior to lining, and container 52 is placed on conveyor 60 as shown in FIG. 1. In the lining position, the partially open bottom of container 52 is moved over the vacuum source 58, end 6 of liner 8 is grasped, separated, opened and pulled over upstanding edges 54, and vacuum is applied to vacuum source 58 which draws liner 8 into container 52. The jaw assemblies 10 open, disengaging from liner 8 as frame 2 moves toward the next liner 8 to be opened. The conveyor 60 then moves the lined container 52 away from the container lining operation and moves another container 52 over vacuum source 58 to begin the process again.

Figure 2:
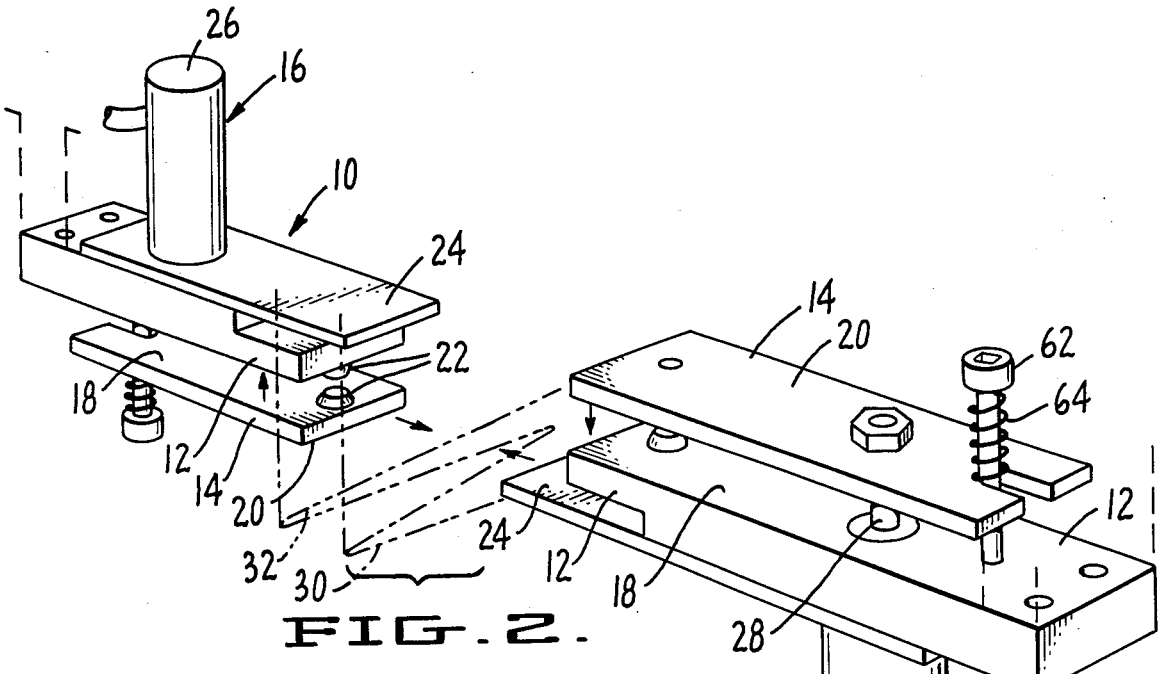
FIG. 2 is a perspective view of the jaw assembly of the present invention.

FIG. 2 shows in detail the jaw assembly 10 of the preferred embodiment. The jaw assembly 10 comprises a first jaw 12 and a second jaw 14, each having an inner surface 18, an outer surface 20, and a gripping surface 22. The gripping surface can be of any material having a high coefficient of friction relative to the material to be grasped, and for polyethylene or other thin, flexible plastic films is preferably a rubber pad or layer. The first jaw 12 and second jaw 14 are preferably attached together using the means for moving the jaws 16, which preferably is a hydraulic or air cylinder 26 attached to first jaw 12 and having a movable piston 28 attached to second jaw 14. A tongue 24 is preferably attached to the outer surface of first jaw 12 using cylinder 26. Tongue 24 can be constructed from any thin, flexible material but preferably is constructed from polytetrafluoroethylene, commonly known as TEFLON or any other similar, flexible material having a low coefficient of friction relative to the material to be grasped. The jaw assemblies 10 are shown in an open position in FIG. 2, such as would result when the pressure within cylinder 26 is increased, forcing piston 28 out of cylinder 26 which, in turn, spaces gripping surface 22 of second jaw 14 away from gripping surface 22 of first jaw 12. In a closed position, the pressure within cylinder 26 is decreased, and piston 28 moves into cylinder 26 which, in turn, brings gripping surface 22 of second jaw 14 into contact with gripping surface 22 of first jaw 12. The pressure between the gripping surfaces 22 in the closed position when the pressure in cylinder 26 has been neutralized may be adjusted using a spring-loaded adjusting device such as screw 62 which is capable of holding the jaws in a closed position when the pressure in cylinder 26 has been neutralized and exerts no force to hold the jaws in a closed position. This is particularly useful for easing the withdrawal of opposing tongue 24 in the separating position while maintaining a grip on the side of the liner 8 with which the gripping surfaces 22 are in direct contact. By neutralizing the pressure in cylinder 26, spring 64 exerts sufficient pressure to enable the jaws maintain a positive grip on the side of the bag which it holds in direct contact, yet does not exert sufficient pressure to impede the withdrawal of opposing tongue 24 and the other side of liner 8 during separation. In the preferred embodiment, the adjusting device is located as shown in FIG. 2 at the back end of second jaw 14 and first jaw 12 such that the spring 64 is located between the outer surface 20 of second jaw 14 and the head of screw 62. When screw 62 is tightened by screwing the threads of screw 62 into a threaded hole on the inner surface 18 of first jaw 12, the spring 64 is compressed and bears against the end of second jaw 14, increasing the pressure between gripping surfaces 22 when the pressure in cylinder 26 has been neutralized. When screw 62 is loosened, by backing screw 62 out of the threaded hole on the inner surface 18 of first jaw 12, the pressure on spring 64 is decreased, decreasing the pressure between gripping surfaces 22 when the pressure in cylinder 26 has been neutralized. In the preferred embodiment, the head of screw 62 and the spring 64, when fully compressed against the head of screw 62, also serve to limit the travel of piston 28 away from cylinder 26.

Figure 3:
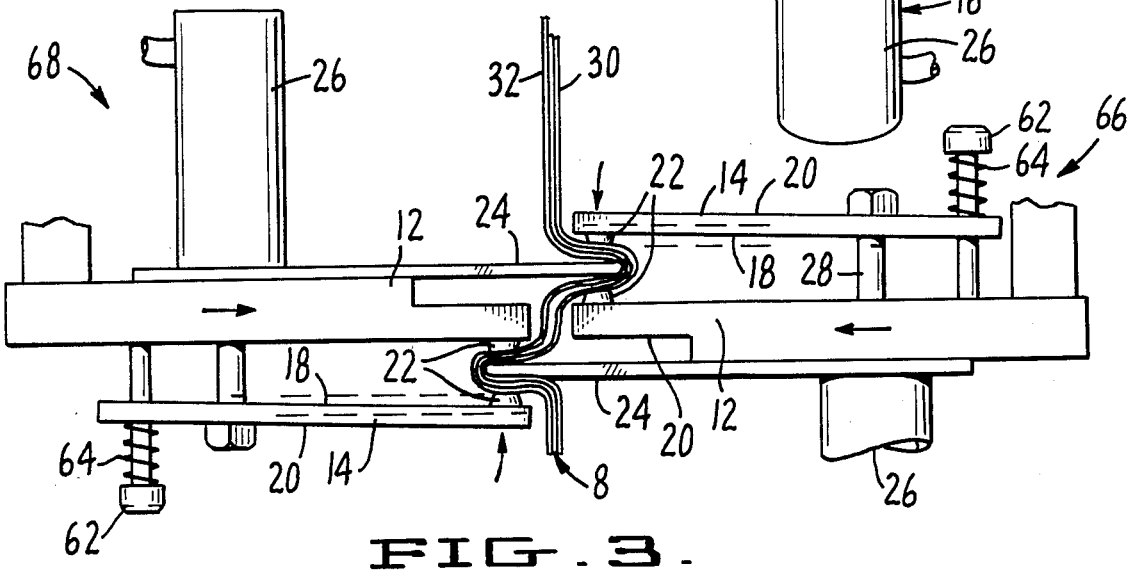
FIG. 3 is a side view of two opposing jaw assemblies in grasping position.
Figure 4:
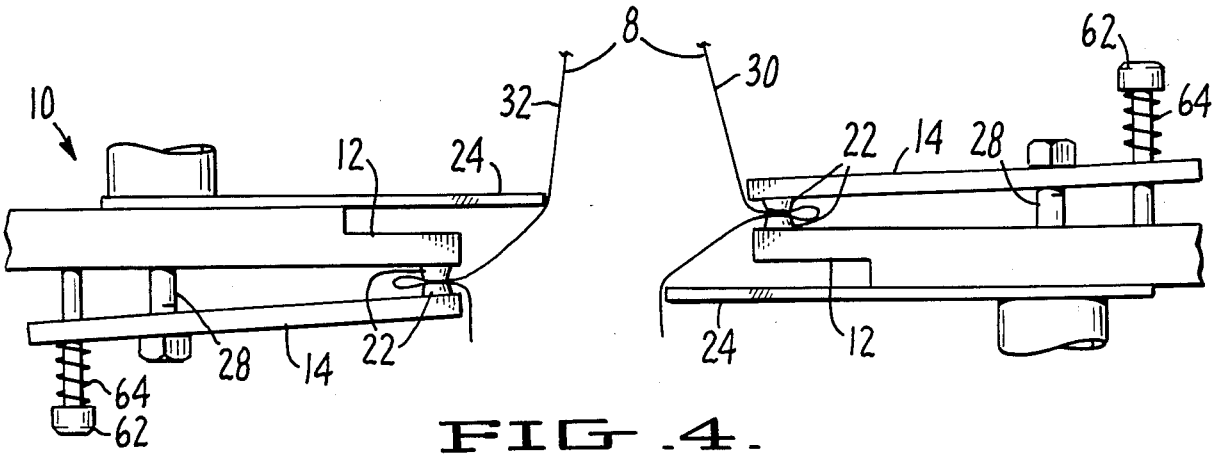
FIG. 4 is a side view of two opposing jaw assemblies in the separating position.

FIGS. 3 and 4 illustrate how the preferred jaw assemblies can be used cooperatively in opposition to each other to enable the grasping of opposite sides of a bag-type liner 8. FIG. 3 shows the grasping phase in which a first jaw assembly 66 is movably mounted on the first side 30 of liner 8 and a second jaw assembly 68 is inverted and movably mounted opposing the first jaw assembly 66 on the second side 32 of liner 8. The jaws of jaw assembly 66 and 68 are opened and the jaw assembly 66 and 68 are each moved toward their respective sides of liner 8. As the jaw assemblies contact liner 8, tongue 24 of first jaw assembly 66 pushes second side 32 and first side 30 of liner 8 between gripping surfaces 22 of the second jaw assembly 68, while, simultaneously, tongue 24 of second jaw assembly 68 pushes first side 30 and second side 32 between the gripping surfaces 22 of first jaw assembly 66. At this point, only side 30 of liner 8 is in direct contact with gripping surfaces 22 of first jaw assembly 66 and only side 32 of liner 8 is in direct contact with gripping surfaces 22 of second jaw assembly 68. In the separating phase, shown in FIG. 4, the jaws close and the tongues 24 slide out from between the layers of liner material as first jaw assembly 66 moves away from second jaw assembly 68. Gripping surface 22 of first jaw assembly 66 grabs and holds first side 30, with which it is in direct contact, and gripping surface 22 of second jaw assembly 68 grabs and firmly holds second side 32 with which it is in direct contact. First jaw assembly 66 pulls the small fold of first side 30 out from between the two layers of second side 32 which is firmly held by second jaw assembly 68 and second jaw assembly 68 pulls the small fold of second side 32 out from between the two layers of first side 30 firmly held by first jaw assembly 66 as the jaw assemblies move apart, securely holding and separating the first side 30 and second side 32 of liner 8.

One skilled in the art will recognize at once that it would be possible to construct the devices of this invention from a variety of materials and to modify the process in a variety of ways. While the preferred embodiment of the present invention has been described in detail, and shown in the accompanying drawings, it will be evident that various further modifications are possible without departing from the scope of the invention.

We claim:

1. An apparatus for pulling apart two layers of flexible film each layer of film having four edges, comprising:

two jaw assemblies facing each other and mounted for relative movement toward and away from each other, with each said jaw assembly having a first jaw member, a second jaw member, and a tongue, the first and second jaw members having a gripping surface which provides a higher coefficient of friction with the film than the coefficient of friction between the two layers of film and being movably mounted to open and close, such that when the jaw members are open, the gripping surface of the first jaw member is spaced away from the gripping surface of the second jaw member and such that when the jaw members are closed the gripping surface of the first jaw member is in contact with and exerts pressure against the gripping surface of the second jaw member;

a means for supporting two layers of flexing film between said jaw assemblies with each of the layers facing one said jaw assembly; and a means for moving said jaw assemblies toward and away from each other such that when the two jaw assemblies are moved toward each other the jaw members open and the tongue on each jaw assembly contacts the film and pushes the film between the open jaw members of the opposite jaw assembly, and such that after the jaw members are closed and said jaw assemblies are moved apart, each jaw assembly retains one of the two layers of flexible film.

2. The apparatus of claim 1 in which each said jaw assembly additionally comprises a means for adjusting the amount of pressure exerted between the gripping surfaces of the first and second jaw members.

3. The apparatus of claim 1 in which the gripping surface of each jaw member comprises a compressible pad.

4. The apparatus of claim 1 in which each first jaw member is fixed and each second jaw member is movable.

5. The apparatus of claim 4 in which the tongue is flexible.

6. The apparatus of claim 5 in which the coefficient of friction between the tongue and the film is less than the coefficient of friction between the two layers of film.

7. The apparatus of claim 1 in which the means for supporting the two layers of flexible film suspends the film by one edge such that the two layers hang freely between the jaw assemblies with each of the layers facing one said jaw assembly.

8. A bag opener for grasping and opening a flexible film bag type liner prior to lining a container, said liner having a first side, a second side, a first edge, a second edge, a sealed end an unsealed end, said bag opener comprising:

a means for suspending the bag type liner from its sealed end;

at least two jaw assemblies mounted on the first side of the liner at the unsealed end, one such jaw assembly being mounted at about the first edge and one such jaw assembly being mounted at about the second edge, and an identical number of jaw assemblies mounted on the second side of the liner facing the jaw assemblies mounted on the first side, each jaw assembly comprising a first jaw, a second jaw, a flexible tongue which extends beyond the first and second jaw, and a means for moving the first and second jaw with respect to each other, each said first and second jaw having an outer surface and a gripping surface, and capable of moving with respect to each other such that when the jaws are open, the gripping surface of the first jaw is spaced away from the gripping surface of the second jaw, and such that when the jaws are closed, the gripping surface of the first jaw is in contact with and exerts pressure against the gripping surface of the second jaw, the gripping surface of the first and second jaws having a coefficient of friction with either side of the liner which is substantially greater than the coefficient of friction between the first and second sides of the liner, the jaw assemblies on the first side of the liner being mounted for relative movement towards and away from the jaw assemblies on the second side of the liner such that when the jaw assemblies on the first side are slidably moved toward the jaw assemblies on the second side, the jaws of each jaw assembly open and the tongues of the jaw assemblies on the first side push both sides of the liner between the gripping surfaces of the jaws of the jaw assemblies on the second side and the tongues of the jaw assemblies on the second side push both sides of the liner between the gripping surfaces of the jaws of the jaw assemblies of the first side thus allowing the jaw assemblies on the first side to grasp and hold the first side of the unsealed end of the liner and the jaw assemblies on the second side to grasp and hold the second side of the unsealed end of the liner when the jaws are closed and the jaw assemblies on the first side are moved away from the jaw assemblies on the second side, for spreading open the unsealed end of the liner; and, a means for slidably moving the jaw assemblies mounted on the first side of the liner towards and into contact with and away from the jaw assemblies mounted on the second side of the liner.

9. The bag opener of claim 8 additionally comprising an air blower for directing a stream of air into the unsealed end of the liner between the first edge, the second edge, the first side and the second side after the first side and second side have been spread open by the jaw assemblies, for completely opening the bag.

10. The bag opener of claim 8 in which the means for moving the jaws of each jaw assembly with respect to each other is an air or hydraulic cylinder.

11. The bag opener of claim 8 in which the means for moving the first and second jaw of each jaw assembly additionally comprises a means for adjusting the amount of pressure exerted between the gripping surfaces of the first and second jaw of each jaw assembly when the jaws are closed.

12. The bag opener of claim 8 in which the means for slidably moving the jaw assemblies mounted on the first side towards and away from the jaw assemblies mounted on the second side of the liner is a chain drive.

13. The bag opener of claim 8 in which said gripping surface of each first and second jaw comprises a compressible pad.

14. The bag opener of claim 8 in which the coefficient of friction of the tongue with either side of the liner is less than the coefficient of friction between the first and second side of the liner.

15. The bag opener of claim 14 in which the tongue is constructed from polytetrafluoroethylene (TEFLON) or other flurorocarbon polymers.

16. The bag opener of claim 8 in which the tongue of each jaw assembly is mounted to the outer surface of one of the jaws.

17. A method for opening flexible film bags having a first side, a second side, a sealed end and an unsealed end, using at least one first jaw assembly mounted on the first side of the bag at the unsealed end and at least one second jaw assembly mounted on the second side of the bag at the unsealed end facing the first jaw assembly, the jaw assembles mounted for relative movement towards and away from each other, each jaw assembly comprising a first jaw, a second jaw, and a tongue, each first and second jaw having a gripping surface and capable of moving such that when the jaws are open, the gripping surface of the first jaw is spaced away from the gripping surface of the second jaw, and such that when the jaws are closed, the gripping surface of the first jaw is in contact with and exerts pressure against the gripping surface of the second jaw, the tongue of each jaw assembly being mounted to extend beyond the jaws of each jaw assembly and to slip between the gripping surfaces of the first and second jaws of the opposite jaw assembly when the jaws are open and the jaw assemblies are moved toward each other, said method comprising:

supporting the bag with the unsealed end between the first jaw assembly and the second jaw assembly with the first side facing the first jaw assembly and the second side facing the second jaw assembly;

opening the jaws on each jaw assembly;

moving the first jaw assembly toward the second jaw assembly until the tongue on the first jaw assembly contacts the bag and pushes both sides of the bag between the gripping surfaces of the first and second jaws of the second jaw assembly and the tongue on the second jaw assembly contacts and pushes both sides of the bag between the gripping surfaces of the first and second jaws of the first jaw assembly;

closing the jaws on each jaw assembly so the both sides of the bag are squeezed by both jaws against the opposing tongue; and, moving the first jaw assembly away from the second jaw assembly to separate the first side from the second side of the bag at the unsealed end.

18. The method of claim 17 additionally comprising the step of directing a stream of air between the first side, the second side, the first edge and the second edge to break any static and completely open the bag.

* * * * *

UNITED STATES PATENT AND TRADEMARK OFFICE

CERTIFICATE OF CORRECTION

PATENT NO. : 4,795,413

DATED : January 3, 1989

INVENTOR(S) : ROBERT B. JOHNSON and ROBERT P. SMITH

It is certified that error appears in the above - identified patent and that said Letters Patent is hereby corrected as shown below:

In The Heading: The following cited U.S. Patent document references should be added:

| | | | |
|---|---|---|---|
| 4,537,584 | 8/1985 | Everman et al. | 493/93 |
| 4,522,012 | 6/1985 | Nelson | 53/175 |
| 4,083,293 | 4/1978 | Goldstein | 93/36.01 |
| 4,052,931 | 10/1977 | Morse et al. | 93/36.01 |
| 4,142,453 | 11/1977 | Gidewall, et al. | 93/36.01 |
| 3,672,122 | 6/1972 | Berger et al. | 53/394 |
| 3,523,492 | 8/1970 | Bruce et al. | 93/36.01 |

In The Claims:

Claim 8, Col. 7, line 7, should read:
"edge, a sealed end and an unsealed end, said bag opener"

Claim 17, Col. 8, line 58, should read:
"closing the jaws on each jaw assembly so [the] that both"

Signed and Sealed this

Twenty-seventh Day of June, 1989

*Attest:*

DONALD J. QUIGG

*Attesting Officer*

*Commissioner of Patents and Trademarks*